United States Patent [19]

Aikawa

[11] Patent Number: 4,561,341

[45] Date of Patent: Dec. 31, 1985

[54] HYDRAULIC CIRCUITRY FOR A BACKHOE

[75] Inventor: Norihiro Aikawa, Sakai, Japan

[73] Assignee: Kubota, Ltd., Japan

[21] Appl. No.: 545,112

[22] Filed: Oct. 25, 1983

Related U.S. Application Data

[63] Continuation of Ser. No. 190,815, Sep. 25, 1980, abandoned.

[30] Foreign Application Priority Data

Jul. 7, 1980 [JP] Japan ..... 55-95532

[51] Int. Cl.[4] ..... F01B 25/02

[52] U.S. Cl. ..... 91/6; 60/484; 60/486; 91/531; 414/687; 414/694

[58] Field of Search ..... 91/6, 531, 530; 60/484, 60/486; 414/687, 694

[56] References Cited

U.S. PATENT DOCUMENTS

| | | | |
|---|---|---|---|
| 3,720,059 | 3/1973 | Schurawski | 91/531 |
| 3,922,855 | 12/1975 | Bridwell | 91/531 |
| 4,112,821 | 9/1978 | Bianchetta | 91/6 |
| 4,179,981 | 12/1979 | Yeou | 91/531 |
| 4,210,061 | 7/1980 | Bianchetta | 91/6 |

*Primary Examiner*—Abraham Hershkovitz

*Attorney, Agent, or Firm*—Kane, Dalsimer, Kane, Sullivan and Kurucz

[57] ABSTRACT

A hydraulic circuitry for a backhoe in which a hydraulic motor for driving one of right and left crawlers and a hydraulic cylinder for vertically oscillating a working arm assembly are connected in parallel to each other to a first pump through a multiplex valve assembly having a first center bypass, and a hydraulic motor for driving the other crawler, a hydraulic motor for slewing a platform, a hydraulic cylinder for flexing and stretching the arm assembly, a cylinder for actuating a bucket and a cylinder for actuating a dozer are connected in parallel to one another to a second pump through a further multiplex valve assembly having a second center bypass. The invention provides a circuit to permit fluid pressure from the first pump to enter the circuit connected to the second pump to provide confluence therein, when the dozer actuating cylinder connected to the second pump, for example, is operated while the backhoe is running. When the motor and/or the cylinder connected to the first pump is (or are) at rest, the cylinders and motors connected to the second pump except the platform slewing motor are arranged to be accelerated.

4 Claims, 2 Drawing Figures

HYDRAULIC CIRCUITRY FOR A BACKHOE

This is a continuation of application Ser. No. 190,815, filed Sept. 25, 1980, now abandoned.

BACKGROUND OF THE INVENTION (1) Field of the Invention

This invention relates to a hydraulic circuitry for a backhoe comprising a multiplex valve assembly provided with a first center bypass and including first and second control valves connected to a hydraulic cylinder for vertically oscillating an arm assembly and to a hydraulic motor for driving one of right and left traveling members, the first and second control valves being connected in parallel to each other to a first pump, and a further multiplex valve assembly provided with a second center bypass and including third to seventh control valves connected to a further hydraulic motor for driving the other traveling member, a hydraulic motor for slewing a platform, a hydraulic cylinder for flexing and stretching the arm assembly, a cylinder for actuating a bucket, and a cylinder for actuating a dozer, the third to seventh control valves being connected in parallel to one another to a second pump.

(2) Description of the Prior Art

The above circuitry for a backhoe enables the most frequently required operations to be carried out while maintaining the pumps at constant working rates, such operations including vertical oscillation of the working arm assembly by the first pump combined simultaneously with one of flexion and stretching of the arm assembly, actuation of the bucket and slewing of the platform by the second pump.

However, when a bulldozing operation is performed together with running of the vehicle, the vehicle will run obliquely. This is because the motor for driving the other traveling member and the cylinder for actuating the dozer are connected in parallel to each other to the second pump and, when the running and the bulldozing operation are effected at the same time, the flow to this motor reduces and brings its revolution rate lower than that of the other motor. To solve this problem a confluence valve may be provided in operative connection with the seventh control valve in order to connect the hydraulic cylinder for actuating the dozer to the first pump. Such a valve arrangement, however, has disadvantages of being large and costly and easy to go into disorder.

On the other hand, it is desired to improve working efficiency by using the pressure fluid of the first pump, when the first pump is at rest, to supply it confluently to the cylinder for flexing and stretching the arm assembly or to the cylinder for actuating the bucket, but not to the platform slewing motor to avoid a dangerous abrupt slewing of the platform. This requirement may be met if two confluence valves are provided to connect those motor and cylinder to a line or lines leading from the first pump and cooperate with the fifth and sixth control valves to provide confluence. Such a valve arrangement again has disadvantages of being large and costly and easy to go into disorder.

SUMMARY OF THE INVENTION

In view of the above state of the art, it is an object of this invention to provide a compact and inexpensive hydraulic circuitry enabling bulldozing operations to be carried out free of oblique running of the vehicle, realizing high working efficiency by accelerating flexion and stretching of the arm assembly and oscillation of the bucket, and yet involving no special confluence valves which would complicate the circuit construction.

A hydraulic circuitry for a backhoe according to this invention is characterized in that the first control valve is disposed upstream of the second control valve relative to the first center bypass, a first block is interposed between the first and second control valves, the third and fourth control valves are disposed upstream of the fifth to seventh control valves relative to the second center bypass, a second block is interposed between the fourth control valve disposed downstream of the third control valve relative to the second center bypass and the fifth control valve disposed upstream of the sixth and seventh control valves relative to the second center bypass, a first confluence line is provided to connect a first center bypass portion included in the first block to a parallel connection line portion included in the second block, a second confluence line is provided to connect a downstream end of the first center bypass to a second center bypass portion included in the second block and to the parallel connection line portion, a check valve is mounted on the first confluence line to prevent flow to the first center bypass portion, a further check valve is mounted on the second confluence line between the second center bypass portion and the parallel connection line portion in the second block to prevent flow to the second center bypass portion, and a third check valve is mounted on a parallel connection line portion connected to the fourth control valve to prevent backflows therein.

The provision of the first and second blocks and the check valves results in the following useful functions, without affecting intrinsic functions to vertically oscillate the arm assembly by the second pump and to flex and stretch the arm assembly, oscillate the bucket or slew the platform by the second pump while maintaining the two pumps at fixed working rates.

Parts of pressure fluids from the first and second pumps are branched off before reaching the control valves for the right and left traveling members, and are confluently supplied to the control valve for the dozer. Therefore, bulldozing operations can be performed without causing oblique running of the vehicle, and this requires no confluence valve referred to hereinbefore. The pressure fluid from the first center bypass extending from the first pump is not supplied to the third and fourth control valves but introduced into the parallel connection line portion below these valves. Thus, when the first pump is at rest, the pressure fluid of the first pump is made to join the pressure fluid from the second pump to flex and stretch the arm assembly and oscillate the bucket at high efficiency, and this requires none of the confluence valves either.

In other words, the most salient characteristics of this invention are prevention of oblique running at times of bulldozing operation and acceleration of arm flexion and stretching and of bucket actuation without affecting the excellent intrinsic functions and with a compact, inexpensive and trouble-free valve arrangement compared with the case of using confluence valves and interlocking mechanisms.

Other objects and advantages of this invention will be apparent from the following description.

BRIEF DESCRIPTION OF THE DRAWINGS

The drawings illustrate a hydraulic circuitry for a backhoe according to this invention, in which.

DETAILED DESCRIPTION OF THE PREFERRED EMBODIMENT

Figure 1:
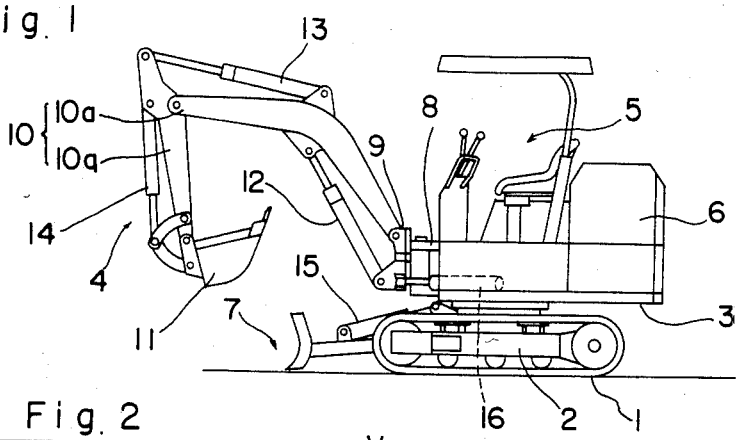
FIG. 1 is a side elevation of the backhoe.

A backhoe is shown to comprise an undercarriage 2 having right and left travelling members or crawlers 1 and carrying a slewing platform 3. The platform 3 carries a horizontally oscillatable and lockable digging implement 4, a driver's cab 5 and an engine section 6. The undercarriage 2 further carries an earth-disposing dozer 7 vertically movable by a hydraulic cylinder 15.

The digging implement 4 comprises a bracket 9 oscillatable by a hydraulic cylinder 16 about a vertical axis relative to a base 8 upstanding on the platform 3, a working arm assembly 10 pivotally connected to the bracket 9 and including a first arm 10*a* and a second arm 10*b* vertically oscillatable and flexible by hydraulic cylinders 12 and 13, and a bucket 11 attached to an extreme end of the arm assembly 10 and actuated by a cylinder 14.

Figure 2:
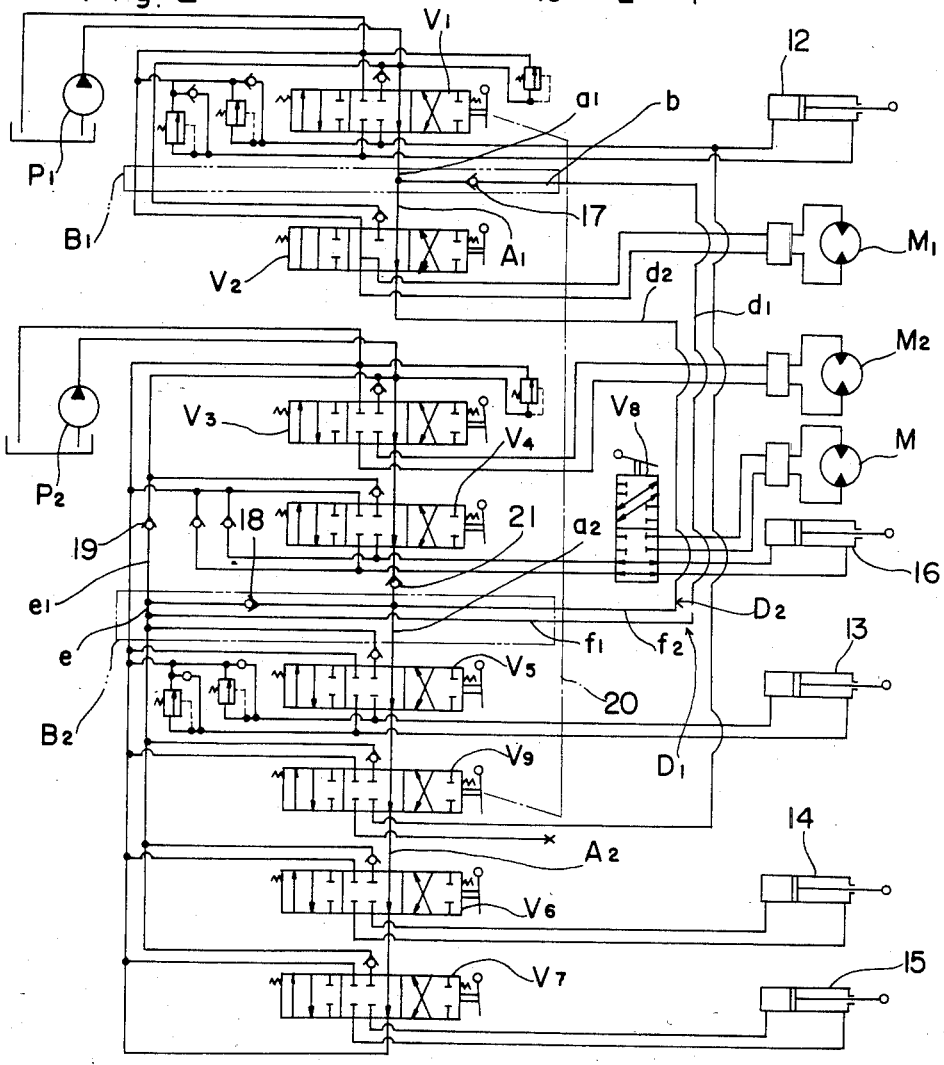
FIG. 2 is a diagram of the hydraulic circuitry.

Referring to FIG. 2, the hydraulic circuitry comprises a multiplex valve assembly provided with a first center bypass A1 and including first and second control valves V1 and V2 connected to the hydraulic cylinder 12 for vertically oscillating the arm assembly 10 and to a hydraulic motor M1 for driving one of crawlers 1 respectively. The first control valve V1 is disposed upstream of the second control valve V2 relative to the first center bypass A1, and the two control valves V1 and V2 are connected in parallel to each other to first pump P1. The first center bypass A1 is connected at a downstream end to a second line d2 for confluence. The hydraulic circuitry comprises a further multiplex valve assembly provided with a second center bypass A2 and including third to seventh control valves V3–V7 connected to a further hydraulic motor M2 for driving the other crawler 1, a hydraulic motor M for slewing the platform 3, the hydraulic cylinder 13 for flexing and stretching the arm assembly 10, the cylinder 14 for actuating the bucket 11 and the cylinder 15 for actuating the dozer 7, respectively. The third and fourth control valves V3 and V4 are disposed upstream of the fifth to seventh control valves V5–V7 relative to the second center bypass A2, and the five control valves V3–V7 are connected in parallel to one another to a second pump P2.

A first block B1 is interposed between the first and second control valves V1 and V2, and a second block B2 between the fourth control valve V4 which is disposed downstream of the third control valve V3 relative to the second center bypass A2 and the fifth control valve V5 which is disposed upstream of the sixth and seventh control valves V6 and V7 relative to the second center bypass A2. The first block B1 includes a first center bypass portion a1, a branch line portion b extending from the portion a1, and a check valve 17 mounted on the branch line portion b to prevent flow to the first center bypass portion a1, the branch line portion b being connected to a first line d1 for confluence. The second block B2 includes a second center bypass portion a2, a parallel connection line portion e, a first confluence line portion f1 connecting the first line d1 for confluence to the parallel connection line portion e thereby providing a first confluence line D1, a second confluence line portion f2 connecting the second line d2 to the second center bypass portion a2 and to the parallel connection line portion e thereby providing a second confluence line D2, and a check valve 18 mounted on the second confluence line portion f2 between the second center bypass portion a2 and the parallel connection line portion e to prevent flow to the second center bypass portion a2.

Furthermore, check valves 19 and 21 are mounted on a parallel connection line portion e1 connected to the fourth control valve V4 which is disposed downstream of the third control valve V3 and on a part of the second center bypass A2 downstream of the fourth control valve V4, respectively, to prevent backflows therein. A change-over valve V8 is provided on a line leading from the fourth control valve V4 to the motor M for slewing the platform 3, and the cylinder 16 for horizontally oscillating the arm assembly 10 is connected to the change-over valve V8, whereby the fourth control valve V4 is selectively operable to slew the platform 3 and to horizontally oscillate the arm assembly 10. A valve V9 is mounted between the fifth control valve V5 for flexing and stretching the arm assembly 10 and the sixth control valve V6 for actuating the bucket 11, to confluently supply pressure fluid from the second pump P2 to the cylinder 12 for raising the arm assembly 10. The confluent flow supply valve V9 is operatively connected to the first control valve V1 for vertically oscillating the arm assembly 10 through an interlocking mechanism 20.

The positions of the third and fourth control valves V3 and V4 may be exchanged relative to the second pump P2. The fifth to seventh control valves V5–V7 and the confluent flow supply valve V9 disposed downstream of the third and fourth control valves V3 and V4 may be arranged in any order, and the confluent flow supply valve V9 may be dispensed with.

While the check valve 17 is disposed in the first block B1 in the above embodiment, it may be mounted on the first line d1 for confluence or in the second block B2.

I claim:

1. A hydraulic circuitry for a backhoe or the like comprising a multiplex valve assembly provided with a first center bypass including at least one first and second control valve connected to a hydraulic cylinder for swinging a boom about a horizontal axis and to a hydraulic motor for driving one of two travelling members, the first and the second control valve being connected in parallel to each other to a first pump, and a second center bypass including at least one third to fifth control valve successively connected to a further hydraulic motor for driving another travelling member, a hydraulic motor for slewing a platform as well as a hydraulic cylinder for flexing and stretching a shovel arm, the third to a fifth control valve being connected in parallel to each other to a second pump and the fourth control valve being downstream of the third control valve and upstream of the fifth control valve; wherein (a) the first control valve ($V_1$) is disposed upstream of the second control valve ($V_2$) relative to the first center bypass;

(b) a sixth control valve ($V_6$) for a hydraulic cylinder (14) for swinging a bucket (11) and a seventh control valve ($V_7$) for a hydraulic cylinder (15) for actuating a dozer (7) are additionally disposed within the second bypass ($A_2$);

(c) the sixth control valve ($V_6$), downstream of the fifth control valve ($V_5$) and upstream of the seventh control valve ($V_7$), is connected to these ones in parallel and to the second pump ($P_2$);

(d) a first block ($B_1$) is interposed between the first ($V_1$) and the second control valve ($V_2$);

(e) a second block ($B_2$) provided between the fourth ($V_4$) and the fifth control valve ($V_5$);

(f) a first confluence line ($D_1$) provided to connect a first center bypass portion (a1) included in the first block ($B_1$) to a parallel connection line portion (e) included in the second block ($B_2$), said first confluence line ($D_1$) being adapted to pass a portion of fluid from the first pump ($P_1$) therethrough into the second center bypass when the hydraulic motor of the first center bypass is brought into operation and also when the work elements of the first center bypass are all idle, first confluence lines ($D^1$) connecting to a connection line (e) so that a plurality of control valves in the second bypass receive a portion of fluid from the first pump ($P^1$);

(g) a second confluence line ($D_2$) provided to connect a downstream end of the first center bypass ($a_1$) to a second center bypass portion (a2) included in the second block ($B_2$) and to the parallel connection line portion (e) said second confluence line ($D_2$) being adapted to pass the remaining portion of fluid from the first pump ($P_1$) therethrough into the second center bypass when the work elements of the first center bypass are all idle;

(h) a check valve (17) mounted on the first confluence line ($D_1$) to prevent backflow of the first center bypass portion (a1);

(i) a further check valve (18) mounted on the second confluence line ($D_2$) between the second center bypass portion (a2) and the parallel connection line portion (e) in the second block ($B_2$) to prevent backflow to the second center bypass portion (a2);

(j) a third check valve (19) mounted on a parallel connection line portion (e or e1) connected to the fourth control valve ($V_4$) to prevent backflow therein; and (k) a fourth check valve (21) mounted in the second bypass ($A_2$) between the fourth ($V_4$) and fifth control valve ($V_5$) to prevent backflow to the fourth control valve ($V_4$).

2. Hydraulic circuitry as claimed in claim 4 further comprising a valve (V9) connected in parallel to the third to seventh control valve to the second pump (P2) to confluently supply pressure fluid from the second pump (P2) to a cylinder (12) for raising an arm assembly, said valve (V9) being operatively connected to the first control valve (V1) through an interlocking mechanism (20).

3. Hydraulic circuitry as claimed in claim 4 or 2 further comprising a change-over valve (V8) mounted on a line leading from the fourth control valve (V4) to a motor (M) for slewing a platform, and a cylinder (16) connected to the change-over valve (V8), for horizontally oscillating an arm assembly (10) whereby the fourth control valve (V4) is selectively operable to slew a platform (3) and to horizontally oscillate an arm assembly (10).

4. Hydraulic circuitry as claimed in claim 1 wherein a conduit passes fluid from the first pump to the second bypass in an unrestricted manner when elements of the first bypass are idle.

* * * * *